US010269295B2

(12) United States Patent
Han et al.

(10) Patent No.: US 10,269,295 B2
(45) Date of Patent: Apr. 23, 2019

(54) ORGANIC LIGHT EMITTING DISPLAY DEVICE AND DRIVING METHOD THEREOF

(71) Applicant: SAMSUNG DISPLAY CO., LTD., Yongin-si, Gyeonggi-do (KR)

(72) Inventors: Sang Myeon Han, Yongin-si (KR); Dong Sup Jin, Yongin-si (KR); Chang Kyu Seol, Yongin-si (KR); Baek Woon Lee, Yongin-si (KR); Jun Jin Kong, Yongin-si (KR); Hong Rak Son, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 152 days.

(21) Appl. No.: 15/156,227

(22) Filed: May 16, 2016

(65) Prior Publication Data

US 2016/0343302 A1 Nov. 24, 2016

(30) Foreign Application Priority Data

May 20, 2015 (KR) ..... 10-2015-0070615

(51) Int. Cl.
*G09G 3/3233* (2016.01)

(52) U.S. Cl.
CPC ..... *G09G 3/3233* (2013.01); *G09G 2320/029* (2013.01); *G09G 2320/0233* (2013.01);
(Continued)

(58) Field of Classification Search
CPC .. G09G 3/3208; G09G 3/2003; G09G 3/3233; G09G 3/3291; G09G 2320/029;
(Continued)

(56) References Cited

U.S. PATENT DOCUMENTS

2001/0008418 A1* 7/2001 Yamanaka ..... H04N 5/3572 348/222.1
2005/0285823 A1* 12/2005 Kimura ..... G09G 3/3241 345/76

(Continued)

FOREIGN PATENT DOCUMENTS

KR 10-2014-0075040 A 6/2014
KR 10-2014-0075061 A 6/2014

(Continued)

*Primary Examiner* — Nalini Mummalaneni
(74) *Attorney, Agent, or Firm* — Lewis Roca Rothgerber Christie LLP

(57) ABSTRACT

A display device includes a display unit including pixels, a memory to store degradation data of the pixels, a group-setting portion to classify the pixels into degradation regions according to a degradation degree and based on the degradation data, perform a contour-simplifying process with respect to the degradation regions, classify the degradation regions into labeling regions according to proximity of adjacent ones of the degradation regions, and set one of the degradation regions as a reference region, a sensor to sense electric characteristics of the degradation regions and the reference region as they separately emit light, a compensation amount controller to compare the electric characteristics of the degradation regions with electric characteristics of the reference region, and calculate a per-position compensation data corresponding to a position of the labeling regions, and a converter to convert a first image data into a second image data based on the per-position compensation data.

11 Claims, 5 Drawing Sheets
(3 of 5 Drawing Sheet(s) Filed in Color)

(52) U.S. Cl.
CPC ..... *G09G 2320/0285* (2013.01); *G09G 2320/043* (2013.01); *G09G 2370/08* (2013.01)

(58) Field of Classification Search
CPC ..... G09G 2320/043; G09G 2320/045; G09G 2320/0276; G09G 2320/0285; G09G 2320/0233; G09G 2320/0295; G09G 2320/041; G09G 2320/046; G09G 2360/16; G09G 2360/141; G09G 2360/145; H05B 33/0896; Y02B 20/36
See application file for complete search history.

(56) References Cited

U.S. PATENT DOCUMENTS

| | | | | |
|---|---|---|---|---|
| 2010/0007656 | A1* | 1/2010 | Okamoto ..... | G09G 3/3233 345/214 |
| 2010/0141626 | A1* | 6/2010 | Tomida ..... | G09G 3/3233 345/211 |
| 2014/0160142 | A1* | 6/2014 | Lee ..... | G09G 3/3208 345/589 |
| 2016/0098952 | A1 | 4/2016 | Han et al. | |

FOREIGN PATENT DOCUMENTS

| | | | |
|---|---|---|---|
| KR | 10-2014-0095276 | A | 8/2014 |
| KR | 10-2016-0041132 | A | 4/2016 |

* cited by examiner

DI

DI_G1

DI_G1_di

DI_G1_di_la

DI_GI_di_la_ma

ORGANIC LIGHT EMITTING DISPLAY DEVICE AND DRIVING METHOD THEREOF

CROSS-REFERENCE TO RELATED APPLICATION

This application claims priority to, and the benefit of, Korean Patent Application No. 10-2015-0070615, filed on May 20, 2015, in the Korean Intellectual Property Office, the entire contents of which are incorporated herein by reference in their entirety.

BACKGROUND

1. Field

Embodiments of the present invention relate to an organic light emitting display device and a driving method thereof, and more particularly, to an organic light emitting display device and a driving method thereof that may correctly compensate degradation of pixels.

2. Description of the Related Art

An organic light emitting display device is configured to display an image by using an organic light emitting diode (OLED) that is configured to generate light by re-combining electrons and holes. Such an organic light emitting display device has been spotlighted as a next generation display device due to quick response speed, low power consumption, and excellent emission efficiency and luminance, and wide viewing angle.

The organic light emitting diode display device has a plurality of pixels arranged in a matrix form and located at crossing regions of a plurality of data lines, scan lines, and power lines. Each of the pixels generally includes an organic light emitting diode, and a pixel circuit for controlling current applied to the organic light emitting diode. The pixels are configured to respectively charge a voltage corresponding to a data signal, and are configured to respectively supply a current corresponding to the charged voltage to the organic light emitting diode, thereby generating light with luminance corresponding to the current.

However, the organic light emitting diodes and the transistors of the pixel circuits that form the pixels of the organic light emitting display device deteriorate depending on light-emitting time and a current amount. In addition, because the organic light emitting diode included in each of the pixels differently deteriorates, a luminance deviation and/or an afterimage may occur.

SUMMARY

An exemplary embodiment of the present invention provides an organic light emitting display device including a display unit including a plurality of pixels, a memory configured to store degradation data of the pixels during display operation, a group-setting portion configured to classify the pixels into a plurality of degradation regions according to a degradation degree and based on the degradation data, perform a contour-simplifying process with respect to each of the degradation regions, classify the degradation regions into a plurality of labeling regions according to proximity of adjacent ones of the degradation regions, and set one of the degradation regions as a reference region, a sensor configured to sense electric characteristics of the degradation regions and the reference region as the regions separately emit light, a compensation amount controller configured to compare the electric characteristics of each of the degradation regions with electric characteristics of the reference region, and calculate a per-position compensation data corresponding to a position of each of the labeling regions, and a converter configured to convert a first image data into a second image data based on the per-position compensation data.

The group-setting portion may be further configured to remove distortion caused by the contour-simplifying process by masking each of the labeling regions.

The sensor may be further configured to sense electric characteristics of a power source supplied to the display unit when the pixels in each of the degradation regions and in the reference region emit light of red, green, and blue colors.

Driving transistors of the pixels may be configured to be controlled to be driven in a linear mode when the electric characteristics are sensed.

The sensor may be configured to sense the electric characteristics several times by varying a power source to output a different voltage for each of the several times.

The compensation amount controller may be further configured to calculate per-region compensation data for each of the degradation regions so that a current amount through the pixels in the degradation regions is similar to a current amount through the pixels in the reference region, and apply a positional deviation compensation value depending on a position of each of the labeling regions in the display unit to the per-region compensation data to calculate the per-position compensation data.

The compensation amount controller may be further configured to calculate the per-region compensation data and the per-position compensation data with reference to a compensation estimation curve relating a degradation-compensating amount to a corresponding degradation degree.

The organic light emitting display device may further include a scan driver configured to transmit scan signals to the pixels through scan lines, and a data driver configured to transmit data signals the pixels through data lines.

Another embodiment of the present invention provides a driving method of an organic light emitting display device, the method including storing degradation data of each of a plurality of pixels during display operation, classifying the pixels into a plurality of degradation regions according to a degradation degree of the pixels based on the degradation data performing a contour-simplifying process for each of the degradation regions classifying the degradation regions into a plurality of labeling regions according to proximity of adjacent ones of the degradation regions setting one of the degradation regions as a reference region emitting light at each of the degradation regions and the reference region separately sensing electric characteristics of the degradation regions and the reference region comparing the electric characteristics of each of the degradation regions with electric characteristics of the reference region, calculating a per-position compensation data corresponding to a position of each of the labeling regions, and converting a first image data into a second image data based on the per-position compensation data.

The driving method may further include removing distortion due to the contour-simplifying process by masking each of the labeling regions.

The sensing of the electric characteristics may include causing pixels in each of the degradation regions and in the reference region to emit light of red, green, and blue colors, and sensing electric characteristics of a power source supplied to the display device.

The calculating of the per-position compensation data may include calculating per-region compensation data for each of the degradation regions so that a current through the pixels in the degradation regions is similar to a current amount through the pixels in the reference region, and applying a positional deviation compensation value depending on a position of the labeling regions in the display device to the per-region compensation data to calculate the per-position compensation data.

The calculating of the per-position compensation data may include calculating the per-region compensation data and the per-position compensation data with reference to a predetermined compensation estimation curve that relates a degradation-compensating amount to a corresponding degradation degree.

BRIEF DESCRIPTION OF THE DRAWINGS

The patent or application file contains at least one drawing executed in color. Copies of this patent or patent application publication with color drawings will be provided by the Office upon request and payment of the necessary fee.

These and/or other aspects will become apparent and more readily appreciated from the following description of the exemplary embodiments, taken in conjunction with the accompanying drawings, in which.

DETAILED DESCRIPTION

Figure 1:
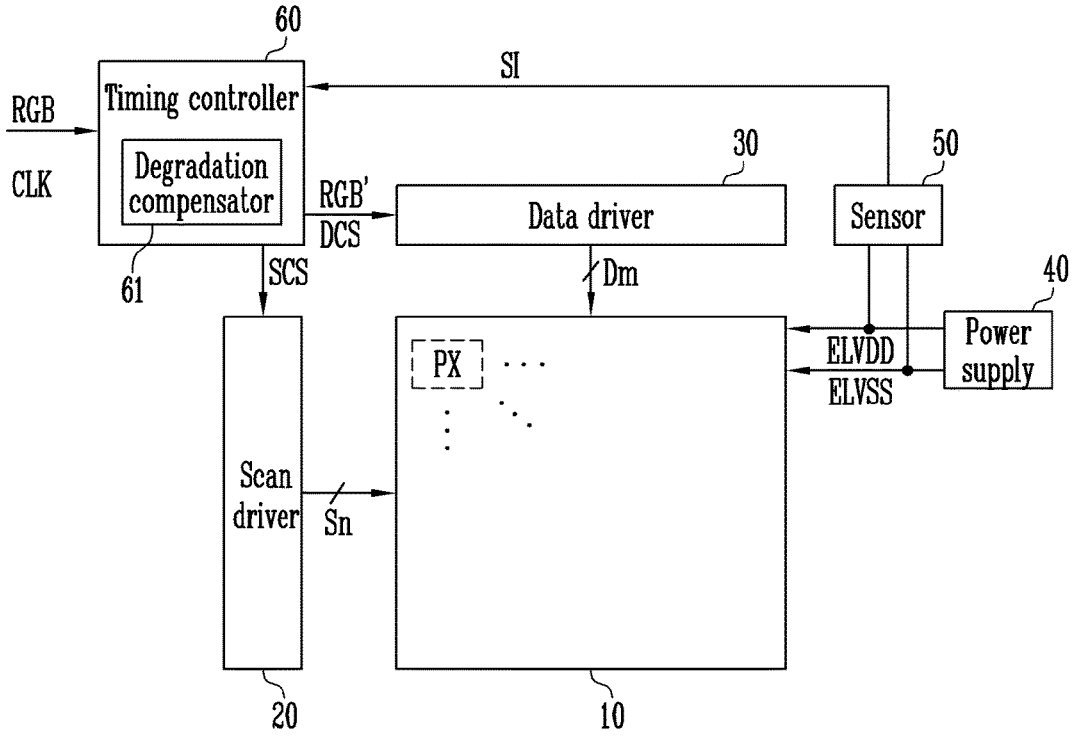
FIG. 1 illustrates a block diagram of an organic light emitting display device according to an exemplary embodiment of the present invention.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, exemplary embodiments of the present invention will now be described more fully with reference to accompanying drawings.

FIG. 1 illustrates a block diagram of an organic light emitting display device according to an exemplary embodiment of the present invention.

Referring to FIG. 1, an organic light emitting display device may include a display unit 10, a scan driver 20, a data driver 30, a power supply 40, a sensor 50, and a timing controller 60.

The display unit 10 includes a plurality of pixels PX arranged in areas at which scan lines Sn and data lines Dm cross. The scan lines Sn may be arranged in a horizontal direction, and the data lines Dm may be arranged in a vertical direction. When scan signals are applied from the scan lines Sn, the pixels PX emit light with luminance corresponding to data signals applied from the data lines Dm.

The scan driver 20 is connected to a plurality of scan lines Sn, is configured to generate a scan signal in response to a scan control signal (SCS) from the timing controller 60, and is configured to output the generated scan signal to the scan lines Sn. The scan driver 20 may be configured of a plurality of stage circuits, and the pixels PX are selected as units each including a horizontal line/row of pixels when the scan signals are sequentially applied to the scan lines Sn.

The data driver 30 is connected to the plurality of data lines Dm, is configured to generate a data signal in response to a data control signal (DCS) from the timing controller 60, and is configured to output the generated data signal to the data lines Dm. Whenever the scan signal is applied, the data signal applied to the data lines Dm is applied to the pixels PX selected by the scan signal. Thus, the pixels PX may charge a voltage corresponding to the data signal.

The power supply 40 is configured to apply a first power source (ELVDD) with a high voltage, and a second power source (ELVSS) with a low voltage, to the display unit 10. Each of the pixels PX that receive the first power source (ELVDD) and the second power source (ELVSS) from the power supply 40 may emit light corresponding to the data signal by a current flowing from the first power source (ELVDD) via an organic light emitting diode (OLED) of the pixel PX to the second power source (ELVSS).

The sensor 50 may sense electric characteristics/electrical characteristics of the power sources (ELVDD and ELVSS) supplied to the display unit 10. Specifically, in a degradation-compensating mode, the display unit 10 is configured to separately emit light in degradation regions defined by a degradation compensator 61, and in a reference region in a corresponding pattern. In the present embodiment, the sensor 50 senses electric characteristics of the first power source (ELVDD) and of the second power source (ELVSS) coupled to the display unit 10, and then supplies sensing information (SI) corresponding to the sensed electric characteristics to the degradation compensator 61. The sensor 50 may be connected (e.g., via sensing lines) to supply lines of the first power source (ELVDD) and of the second power source (ELVSS) that supply power to the display unit 10 from the power supply 40. For example, the sensor 50 may measure voltage or current of the power sources (ELVDD and ELVSS) coupled to the display unit 10 by using a measurement resistor.

The timing controller 60 is configured to receive image data (RGB) and a clock signal (CLK) for controlling a display of the image data (RGB). The timing controller 60 is configured to generate image data (e.g., corrected image data) (RGB'), which is corrected to be suitable for displaying an image on the display unit 10 and to be outputted to data driver 30, by processing the received image data (RGB). In addition, the timing controller 60 is configured to generate and output driving control signals (SCS and DCS) for controlling operations of the scan driver 20 and the data driver 30 based on the clock signal (CLK). Specifically, the timing controller 60 may generate the scan driving control signal (SCS), and may supply the generated scan driving control signal (SCS) to the scan driver 20, and the timing controller 60 may generate the data driving control signal (DCS), and may supply the generated data driving control signal (DCS) to the data driver 30.

The timing controller 60 may include the degradation compensator 61 for compensating the degradation of the display unit 10. In the degradation-compensating mode, the degradation compensator 61 is configured to determine a degradation amount for each pixel by using the sensing information (SI) supplied from the sensor 50, and is configured to group the pixels PX of the display unit 10 into several groups depending on a determined result. Thus, the degradation compensator 61 is configured to define degradation regions, and labeling regions into which the degradation regions are subdivided. In addition, the degradation compensator 61 is configured to compare the degradation degrees (e.g., a degree of degradation) of the degradation regions with the degradation degrees of the reference regions to thereby calculate a degradation compensation value corresponding to each of the degradation regions, and is configured to generate or update compensation data for each position/region by considering the labeling regions divided based on a position thereof. In the present exemplary embodiment, the degradation compensator 61 is described as a structure that is integrally included in the timing controller 60, although the present invention is not limited thereto (i.e., in other embodiments, the degradation compensator 61 may be an independent structure that is separate from the timing controller 60).

Figure 2:
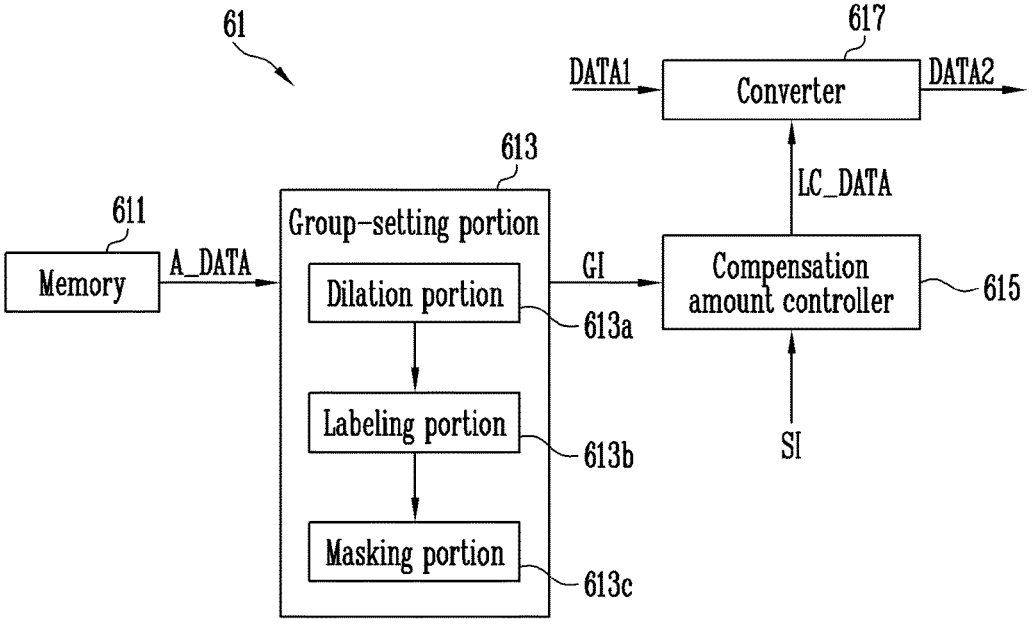
FIG. 2 illustrates a detailed block diagram of a degradation compensator of the organic light emitting display device of FIG. 1.
Figure 3A:
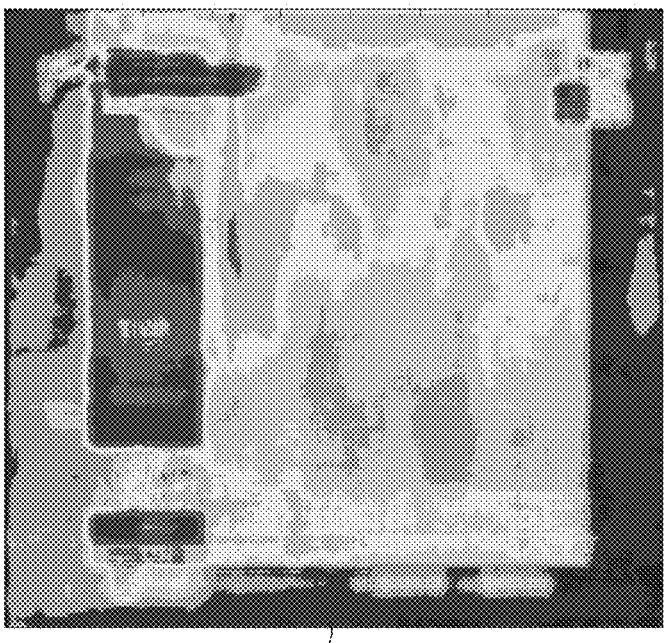
FIG. 3A illustrates degradation data images depending on a degradation degree of a pixel.
Figure 3B:
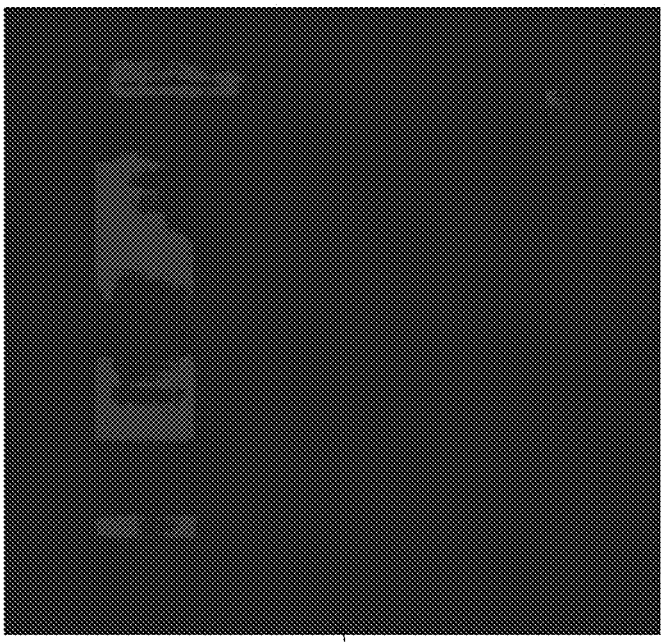
FIG. 3B illustrates a first degradation region of the degradation data images of FIG. 3A.
Figure 3C:
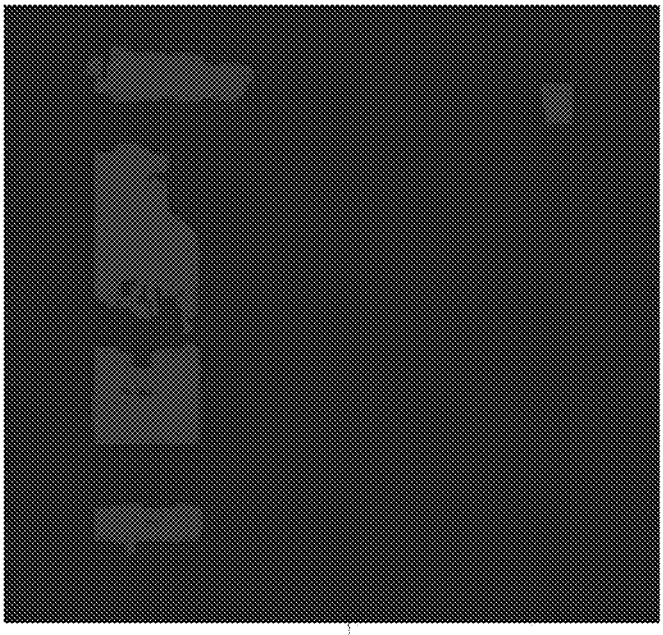
FIG. 3C illustrates the first degradation region for which a contour-simplifying process is performed.
Figure 3D:
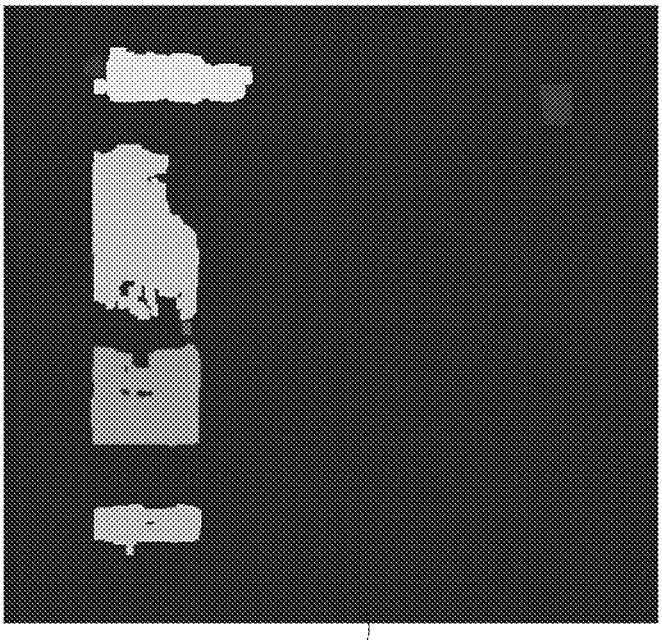
FIG. 3D illustrates the first degradation region divided into labeling regions.
Figure 3E:
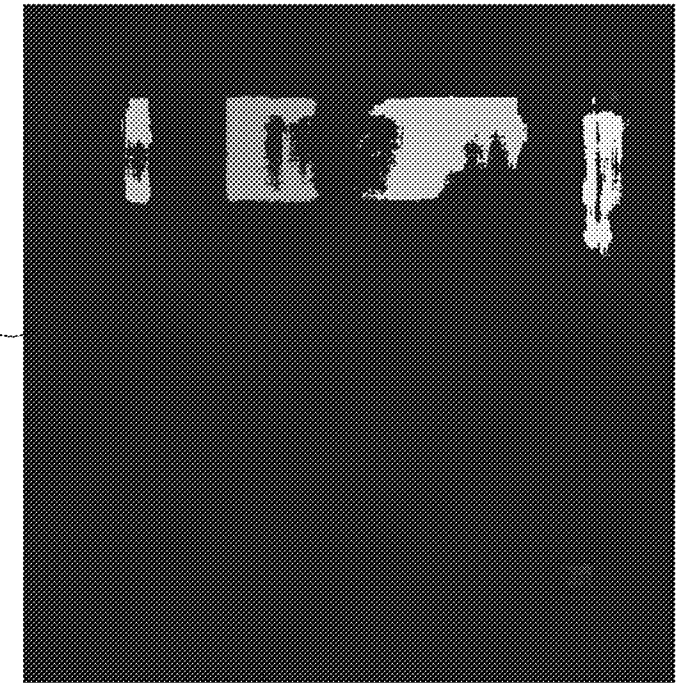
FIG. 3E illustrates the first degradation region processed by a masking.

FIG. 2 illustrates a detailed block diagram of a degradation compensator of the organic light emitting display device of FIG. 1, FIG. 3A illustrates degradation data images depending on a degradation degree of a pixel, FIG. 3B illustrates a first degradation region of the degradation data images of FIG. 3A, FIG. 3C illustrates the first degradation region for which a contour-simplifying process is performed, FIG. 3D illustrates the first degradation region divided into labeling regions, and FIG. 3E illustrates the first degradation region processed by a masking.

Referring to FIG. 2, the degradation compensator 61 according to the exemplary embodiment of the present invention may include a memory 611, a group-setting portion 613, a compensation amount controller 615, and a converter 617.

Degradation data (A_DATA) for each of the plurality of pixels PX is stored in the memory 611 during a display operation. For example, the degradation data (A_DATA) may be accumulation data for each pixel PX. In the degradation-compensating mode, the memory 611 is configured to supply the degradation data (A_DATA), which may be updated by using position compensation data (LC_DATA) that is calculated by the compensation amount controller 615.

In the degradation compensator 61, the group-setting portion 613 is configured to reads out the degradation data (A_DATA) of each pixel PX stored in the memory 611, and is configured to group pixels into several groups having a similar degradation degree based on the degradation data (A_DATA). Thus, the group-setting portion 613 may define a plurality of degradation regions and a plurality of labeling regions into which the degradation regions are subdivided. In addition, the group-setting portion 613 may set one of the degradation regions as a reference region. In this case, the reference region may be set by grouping pixels that have degradation degrees in a reference range (e.g., a predetermined reference range). The group-setting portion 613 is configured to output grouping information (GI), which is with respect to the predetermined degradation regions, the labeling regions, and the reference region, to the compensation amount controller 615.

The group-setting portion 613 may include a dilation portion 613*a*, a labeling portion 613*b*, and a masking portion 613*c*.

Referring to FIGS. 3A and 3B, the group-setting portion 613 is configured to adaptively divide a plurality of levels, which depend on the degradation degree of the pixels (e.g., each level corresponding to a range of the degradation degree), based on the degradation data (A_DATA) supplied from the memory 611, and is configured to divide the pixels for each level, and then generate a binary data image (DI). Here, the number of the levels for classifying the degradation degree may be predetermined, and the number of the levels may correspond to a number of the degradation regions. In the present exemplary embodiment, it is assumed that the data image (DI) is divided into eight degradation regions, and a grouping process with respect to a data image (DI_G1) of a first degradation region, which corresponds to the greatest degradation degree that is sensed, will be described. The data images of the remaining degradation regions are also processed in the same way.

Referring to FIG. 3C, the dilation portion 613*a* is configured to perform a contour-simplifying process with respect to the plurality of divided degradation regions to generate a data image (DI_G1_di). The contour-simplifying process simplifies the contour of the degradation region by removing components including pixels of a number, which is equal to or less than a predetermined reference number, from the data image (DI_G1) of the first degradation region.

Referring to FIG. 3D, the labeling portion 613*b* is configured to classify adjacent ones of the degradation regions depending on a degree of their proximity into a plurality of labeling regions to generate a labeling data image (DI_G1_di_la). The labeling process performed by the labeling portion 613*b* labels figures in adjacent regions of the dilation data image (DI_G1_di) as a single group by using an image connected component labeling method. The various labeling regions may be represented by different colors in the labeling data image (DI_G1_di_la).

Referring to FIG. 3E, the masking portion 613*c* is configured to mask each of the labeling regions to generate a masking image (DI_G1_di_la_ma) in which a distortion due to the contour-simplifying process of FIG. 3C is removed. The masking process removes all distorted regions through dilation by masking the labeling data image (DI_G1_di_la) with the initial data image (DI). However, the masking image (DI_G1_di_la_ma) includes the labeling regions.

The contour-simplifying process and the masking process may be selectively performed, or may be changed according to the capacity of the memory 611 or the securement of calculating resources. Particularly, the contour-simplifying process may be variously implemented depending on setting of a parameter of a dilation filter.

The compensation amount controller 615 is configured to compare electric characteristics of each of the degradation regions with electric characteristics of the reference region based on the grouping information (GI) supplied from the group-setting portion 613, and based on the sensing information (SI) supplied from the sensor 50, and is configured to calculate the per-position/per-region compensation data (LC_DATA) for each position corresponding to each of the labeling regions. In the degradation-compensating mode, the display unit 10 is driven so that the pixels that are included in the degradation regions and in the reference region may emit light in each of red (R), green (G), and blue (B) colors, and the sensor 50 senses the electric characteristics of the power sources (ELVDD and ELVSS) supplied to the display unit 10, and then supplies information (SI) associated with the sensed electric characteristics to the compensation amount controller 615.

Specifically, the compensation amount controller 615 is configured to calculate a per-region compensation data for each of the degradation regions so that the current amount through the pixels in the degradation regions is similar to the current amount of the pixels included in the reference region. In addition, the compensation amount controller 615 is configured to apply a positional deviation compensation value, which depends on a position at which each of the labeling regions is positioned in the display unit 10, to the per-region compensation data to calculate the per-position compensation data (LC_DATA). That is, the compensation amount controller 615 is configured to apply a per-position compensation value, which depends on panel distribution, to the per-region compensation data that is classified depending on the degradation degree, thereby improving the precision of the degradation compensation. In this case, the compensation amount controller 615 may calculate the per-region compensation data and the per-position compensation data (LC_DATA) with reference to a compensation estimation curve, which relates a degradation-compensating amount to the degradation degree.

The converter 617 is configured to convert a first image data (DATA1) into a second image data (DATA2) based on the per-position compensation data (LC_DATA) supplied from the compensation amount controller 615. The converter 617 may adjust a gray scale for each of the red (R), green (G), and blue (B) colors of the first image data (DATA1) depending on the per-position compensation data (LC_DATA).

Figure 4:
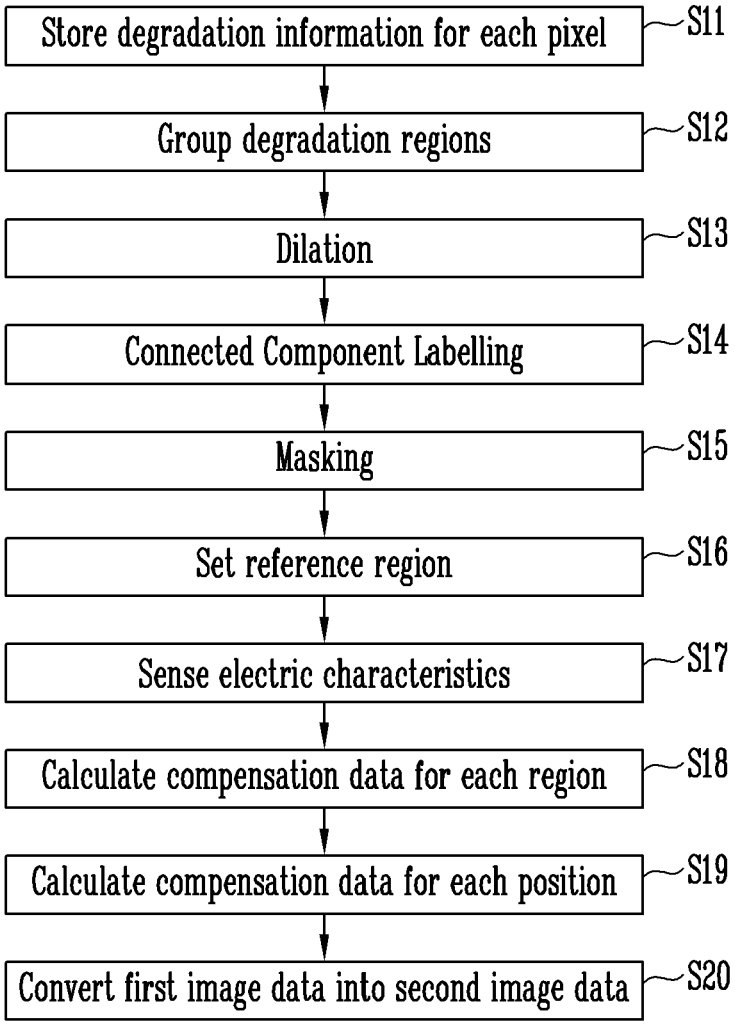
FIG. 4 illustrates a flowchart of a driving method of an organic light emitting display device according to an exemplary embodiment of the present invention.

FIG. 4 illustrates a flowchart of a driving method of an organic light emitting display device according to an exemplary embodiment of the present invention.

Referring to FIG. 4, degradation data/information for each of a plurality of pixels is stored in the memory during display operation (S11). For example, the degradation data (A_DATA) may be accumulation data for each pixel.

Next, the pixels are classified/grouped into the plurality of degradation regions depending on a corresponding degradation degree that is based on the degradation data (S12). In the present embodiment, the group-setting portion 613 adaptively divides the plurality of levels (e.g., divides a range of degradation degrees) depending on the degradation degree of the pixels based on the degradation data (A_DATA) supplied from the memory 611, groups the pixels for each level, and then generates the binary data image (DI).

Next, the contour-simplifying process (e.g., dilation) is performed for each of the degradation regions (S13). In the present embodiment, the dilation portion 613*a* performs dilation/the contour-simplifying process for each of the plurality of divided degradation regions to generate the dilation data image (DI_G1_di). The contour-simplifying process simplifies the contour of the degradation region by removing components that include a number of pixels that is equal to or less than a reference number from the data image (DI_G1) of the first degradation region.

Next, adjacent ones of the degradation regions are respectively classified into the plurality of labeling regions (e.g., connected component labelling) depending on a degree of their proximity (S14). In the present embodiment, the labeling portion 613*b* classifies the degradation regions into the plurality of labeling regions depending on their proximity to each other to generate a labeling data image (DI_G1_di_la). During the labeling process, shapes/figures that are in adjacent regions of the dilation data image (DI_G1_di) are labeled as individual groups by using an image connected component labeling method.

Next, the labeling regions are respectively masked, such that distortion due to the contour-simplifying process is removed (S15). In the present embodiment, the masking portion 613*c* masks each of the labeling regions to generate the masking image (DI_G1_di_la_ma) in which the distortion due to the contour-simplifying process is removed. The masking process removes all distorted regions due to the dilation by masking the labeling data image (DI_G1_di_la) with the initial data image (DI). However, the masking image (DI_G1_di_la_ma) includes portions of the labeling regions.

Next, one of the degradation regions is set as the reference region (S16). In the present embodiment, the group-setting portion 613 may set the reference region by grouping the pixels having degradation degrees that are in the reference range. The group-setting portion 613 outputs the grouping information (GI), which corresponds to the predetermined degradation regions, the labeling regions, and the reference region, to the compensation amount controller 615.

Next, the degradation regions and the reference region each separately emit light to enable sensing of the electric characteristics (S17). In the present embodiment, in the degradation-compensating mode, the display unit 10 is driven so that the pixels respectively included in the degradation regions and the reference region emit light in red (R), green (G), and blue (B) colors, and the sensor 50 senses the electric characteristics of the power sources (ELVDD and ELVSS) supplied to the display unit 10, and then supplies information (SI) associated with the sensed electric characteristics to the compensation amount controller 615. According to the sensed electric characteristics, the driving transistors included in the pixels PX are driven in a linear mode for the gate-source voltage difference (Vgs) to be the maximum, and the first power source (ELVDD) may be applied at about 5 to 7 different voltage levels. In addition, it is possible to improve the precision of measurement by performing the sensing process several times while the voltage of the first power source (ELVDD) is varied.

Next, the per-region compensation data for each of the degradation regions is calculated so that the current amount of the pixels included in the degradation regions is similar to the current amount of the pixels included in the reference region (S18). For example, when the current amount of the degradation region is determined to be smaller than that of the reference region based on a comparison of sensing information (SI) of a predetermined degradation region and sensing information (SI) of the reference region, then the degradation amount of the pixels included in the degradation region is determined to be greater than a reference degradation amount. Contrastingly, when the current amount of the degradation region is determined to be greater than that of the reference region, the degradation amount of the pixels included in the degradation region is determined to be smaller than the reference degradation amount. The per-region compensation data may be calculated by increasing or decreasing the degradation compensation amount above or below a reference-setting value depending on the determined result.

Next, the positional deviation compensation value depending on the position at which each of the labeling regions is positioned in the display unit is applied to the per-region compensation data, such that the per-position compensation data is calculated for each position (S19). That is, the per-position compensation value depending on the panel distribution is applied to the per-region compensation data that is classified depending on the degradation degree, such that precision of the degradation compensation is improved. In this case, the compensation amount controller 615 may calculate the per-region compensation data and the per-position compensation data (LC_DATA) with reference to a compensation estimation curve correlating a degradation-compensating amount to the degradation degree.

Next, the first image data is converted into the second image data based on the per-position compensation data (S20). The converter 617 may adjust a gray scale for each of the red (R), green (G), and blue (B) colors of the first image data (DATA1) depending on the per-position compensation data (LC_DATA).

As described above, it is possible to improve precision of degradation compensation by performing a contour-simplifying process and a labeling process for each of degradation regions, and by subdividing degradation regions based on degradation degrees thereof, mutual proximity therebetween, and a position thereof in a display panel configured to perform degradation compensation.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. An organic light emitting display device, comprising:
a display unit comprising a plurality of pixels;
a memory configured to store degradation data comprising accumulation data of the pixels during display operation;
a group-setting portion configured to:
classify the pixels into a plurality of degradation regions according to a degradation degree and based on the degradation data;
perform a contour-simplifying process with respect to each of the degradation regions;
classify the degradation regions into a plurality of labeling regions according to proximity of adjacent ones of the degradation regions; and
set one of the degradation regions as a reference region;
a sensor configured to sense electric characteristics of the degradation regions and the reference region as the regions separately emit light;
a compensation amount controller configured to:
compare the electric characteristics of each of the degradation regions with electric characteristics of the reference region; and
calculate a per-position compensation data corresponding to a position of each of the labeling regions; and
a converter configured to convert a first image data into a second image data based on the per-position compensation data,
wherein the compensation amount controller is further configured to:
calculate per-region compensation data for each of the degradation regions so that a current amount through the pixels in the degradation regions is similar to a current amount through the pixels in the reference region; and
apply a positional deviation compensation value depending on a position of each of the labeling regions in the display unit to the per-region compensation data to calculate the per-position compensation data.

2. The organic light emitting display device of claim 1, wherein the group-setting portion is further configured to remove distortion caused by the contour-simplifying process by masking each of the labeling regions with an initial data image corresponding to the first image data.

3. The organic light emitting display device of claim 1, wherein the sensor is further configured to sense electric characteristics of a power source supplied to the display unit when the pixels in each of the degradation regions and in the reference region emit light of red, green, and blue colors.

4. The organic light emitting display device of claim 1, wherein driving transistors of the pixels are configured to be controlled to be driven in a linear mode when the electric characteristics are sensed.

5. The organic light emitting display device of claim 1, wherein the sensor is configured to sense the electric characteristics several times by varying a power source to output a different voltage for each of the several times.

6. The organic light emitting display device of claim 1, wherein the compensation amount controller is further configured to calculate the per-region compensation data and the per-position compensation data with reference to a compensation estimation curve relating a degradation-compensating amount to a corresponding degradation degree.

7. The organic light emitting display device of claim 1, further comprising:
a scan driver configured to transmit scan signals to the pixels through scan lines; and
a data driver configured to transmit data signals to the pixels through data lines.

8. A driving method of an organic light emitting display device, the method comprising:
storing degradation data comprising accumulation data of each of a plurality of pixels during display operation;
classifying the pixels into a plurality of degradation regions according to a degradation degree of the pixels based on the degradation data;
performing a contour-simplifying process for each of the degradation regions;
classifying the degradation regions into a plurality of labeling regions according to proximity of adjacent ones of the degradation regions;
setting one of the degradation regions as a reference region;
emitting light at each of the degradation regions and the reference region separately;
sensing electric characteristics of the degradation regions and the reference region;
comparing the electric characteristics of each of the degradation regions with electric characteristics of the reference region;
calculating a per-position compensation data corresponding to a position of each of the labeling regions; and
converting a first image data into a second image data based on the per-position compensation data,
wherein the calculating of the per-position compensation data comprises:
calculating per-region compensation data for each of the degradation regions so that a current through the pixels in the degradation regions is similar to a current amount through the pixels in the reference region; and
applying a positional deviation compensation value depending on a position of the labeling regions in the display device to the per-region compensation data to calculate the per-position compensation data.

9. The driving method of the organic light emitting display device of claim 8, further comprising removing distortion due to the contour-simplifying process by masking each of the labeling regions with an initial data image corresponding to the first image data.

10. The driving method of the organic light emitting display device of claim 8, wherein the sensing of the electric characteristics comprises:

causing pixels in each of the degradation regions and in the reference region to emit light of red, green, and blue colors; and sensing electric characteristics of a power source supplied to the display device.

11. The driving method of the organic light emitting display device of claim 8, wherein the calculating of the per-position compensation data comprises calculating the per-region compensation data and the per-position compensation data with reference to a predetermined compensation estimation curve that relates a degradation-compensating amount to a corresponding degradation degree.

* * * * *